US006140593A

United States Patent [19]

Bramesfeld et al.

[11] Patent Number: 6,140,593

[45] Date of Patent: Oct. 31, 2000

[54] SWITCH ARRAY

[75] Inventors: Wulf Bramesfeld, Wuelfrath; Thomas Plinta, Schwelm; Anke Wilhelm, Radevormwald; Harald Krause, Hattingen, all of Germany

[73] Assignee: Delphi Technologies, Inc., Troy, Mich.

[21] Appl. No.: 09/379,688

[22] Filed: Aug. 24, 1999

[30] Foreign Application Priority Data

Sep. 1, 1998 [DE] Germany ..... 198 39 811

[51] Int. Cl.[7] ..... H01H 13/70

[52] U.S. Cl. ..... 200/5 A; 200/517; 200/341

[58] Field of Search ..... 200/5 R, 5 A, 200/18, 512–517, 341–345, 520; 400/472, 490, 491, 491.2, 495, 495.1, 496

[56] References Cited

U.S. PATENT DOCUMENTS

| | | | |
|---|---|---|---|
| 4,317,968 | 3/1982 | Kuhfus | 200/5 R |
| 5,333,961 | 8/1994 | Capigatti et al. | 400/490 |
| 5,579,002 | 11/1996 | Iggulden et al. | 341/23 |
| 5,588,760 | 12/1996 | So | 400/495 |
| 5,734,137 | 3/1998 | Wakefield | 200/5 A |
| 5,739,486 | 4/1998 | Buckingham | 200/5 A |
| 5,892,192 | 4/1999 | Ishiguro et al. | 200/5 R |

FOREIGN PATENT DOCUMENTS

| | | | |
|---|---|---|---|
| 2928638 | 4/1980 | Germany | G06F 3/02 |
| 29609439 U1 | 9/1996 | Germany | H01H 13/52 |
| 4436050C2 | 1/1997 | Germany | B66B 3/00 |

*Primary Examiner*—Michael Friedhofer
*Attorney, Agent, or Firm*—Richard A. Jones

[57] ABSTRACT

A switch array (10) comprising a housing (12) having a front face (14), a rear face (16), and a number of through bores (18) extending from the front face to the rear face; a resilient switch card (30) having a front face (34) directed towards the rear face of the housing, a rear face (36) directed away from the housing, and a number of contact areas (38) on the front face associated with each through bore, wherein the number and position of the contact areas associated with each through bore is identical; a switch cap (20) slidably mounted in, and removable from, one of the through bores, the switch cap having a front face (22) adjacent the front face of the housing, a rear face (24) adjacent the rear face of the housing, and one or more pins (28) projecting from the rear face of the switch cap, wherein the number and position of the or each pin is predetermined, and wherein the or each pin can exert pressure on one of the contact areas associated with the through bore on pushing the switch cap from a rest position; an electrical circuit board (32) mounted on the rear face of the resilient switch card and having an electrical circuit associated with each contact area such that when pressure is exerted on one of the contact areas, an electrical signal is generated in the associated electrical circuit. Using two or more switch caps with unique numbers and positions for the pins allows selection of the switch caps by an operator, and the relative positions of the switch caps to be selected.

10 Claims, 2 Drawing Sheets

SWITCH ARRAY

TECHNICAL FIELD

The present invention relates to a switch array, and in particular a switch array for a motor vehicle.

BACKGROUND OF THE INVENTION

A large number of electrical switches are mounted in a motor vehicle, especially in and around the dashboard. Especially in the dashboard area, arrays of switches may be mounted. Each switch is operated to actuate or de-actuate different electrically operated devices. Once a switch array is mounted in the dashboard, it is very difficult to add new switches, remove switches, or alter the position of switches.

SUMMARY OF THE INVENTION

It is an object of the present invention to provide a switch array which overcomes the above mentioned problems.

A switch array in accordance with the present invention comprises a housing having a front face, a rear face, and a number of through bores extending from the front face to the rear face; a resilient switch card having a front face directed towards the rear face of the housing, a rear face directed away from the housing, and a number of contact areas on the front face associated with each through bore, wherein the number and position of the contact areas associated with each through bore is identical; a switch cap slidably mounted in, and removable from, one of the through bores, the switch cap having a front face adjacent the front face of the housing, a rear face adjacent the rear face of the housing, and one or more pins projecting from the rear face of the switch cap, wherein the number and position of the or each pin is predetermined, and wherein the or each pin can exert pressure on one of the contact areas associated with the through bore on pushing the switch cap from a rest position; an electrical circuit board mounted on the rear face of the resilient switch card and having an electrical circuit associated with each contact area such that when pressure is exerted on one of the contact areas, an electrical signal is generated in the associated electrical circuit.

The switch cap is associated with an electrically operated device. When a signal is generated, the electrically operated device can be operated as required. In a preferred arrangement where two or more switch caps are provided, each switch cap has a unique number and/or position for the or each pin. Each switch cap will therefore generate a unique electrical signal when pushed. From the generated signal, the required electrically operated device selected for operation can be determined. The switch caps can be moved from one through bore to another, removed entirely, or replaced by new switch caps, to allow the operator to select which switch caps are required, and the relative positioning of the switch caps.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
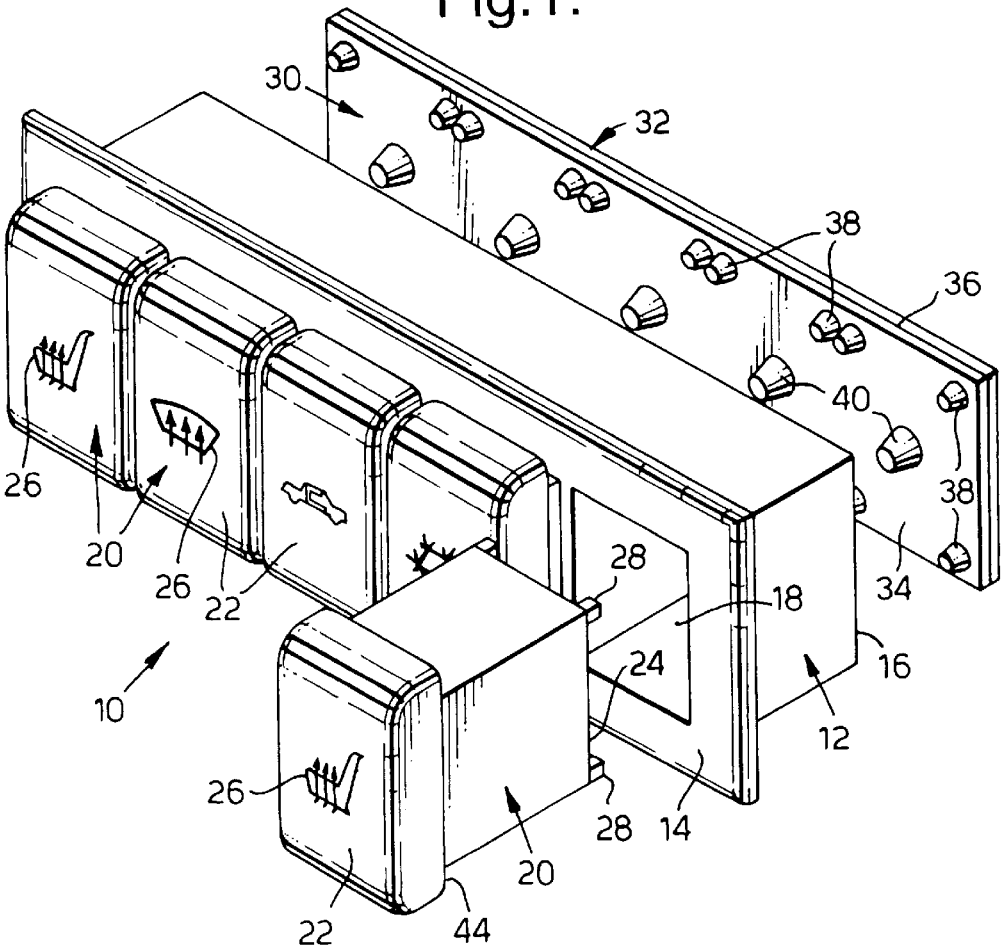
FIG. 1 is an exploded view of a switch array in accordance with the present invention.
Figure 3:
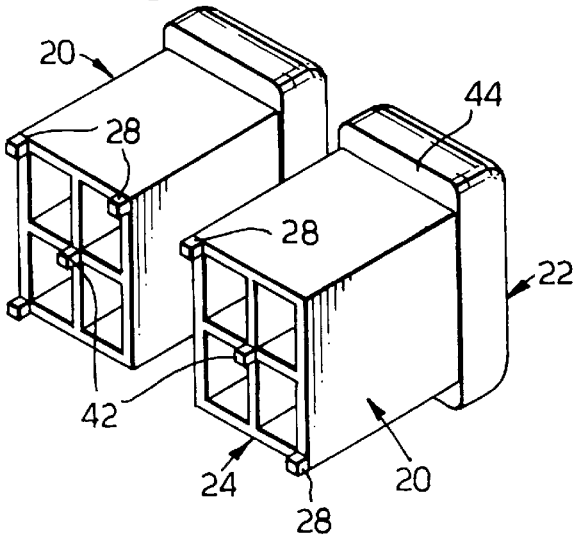
FIG. 3 is a perspective view of the rear face of some of the switch caps of the switch array of FIG. 1.
Figure 2:
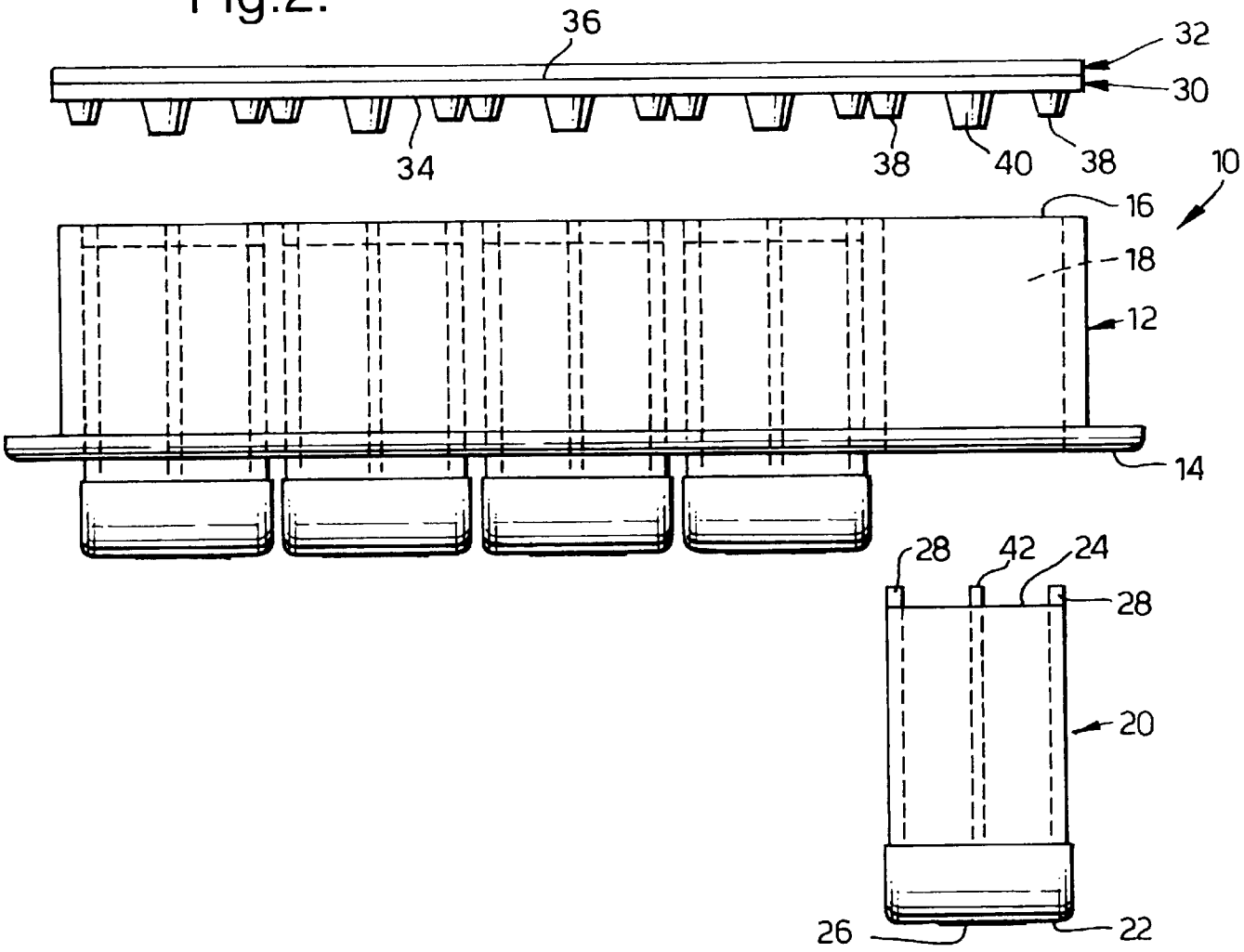
FIG. 2 is a top view of the switch array of FIG. 1.

Referring to the drawings, the switch array 10 in accordance with the present invention is for mounting in a dashboard (not shown) of a motor vehicle and comprises a housing 12 having a front face 14 and a rear face 16, with through bores 18 extending from the front face to the rear face. A switch cap 20 is slidably mounted in each through bore 18, and can be removed from the through bore. Each switch cap 20 has a front face 22 positioned adjacent the front face 14 of the housing 12, and a rear face 24 positioned adjacent the rear face 16 of the housing. The front face 22 of each switch cap 20 has a symbol 26 marked thereon to indicate which electrical device (not shown) is to be controlled. The rear face 24 of each switch cap 20 has one or more pins 28 projecting therefrom, the number of pins and the position of the or each pin being predetermined dependent on the electrically operated device to be controlled, with the predetermined number/position being unique for each electrically operated device.

Attached to the rear face 16 of the housing 12 is a resilient switch card 30 (for example, an elastomeric sheet) and electrical circuit board 32 (for example, a printed circuit board or flexible printed circuit). The resilient switch card 30 has a front face 34 directed towards the rear face 16 of the housing 12, and a rear face 36 directed towards the electrical circuit board 32. The resilient switch card 30 has, associated with each through bore 18 in the housing 12, a predetermined number of contact areas 38 at predetermined positions, the number and positions being the same for each through bore. The predetermined number of contact areas 38 is equal to the maximum possible number of pins 28 which may project from the rear face 24 of a switch cap 20, and the position of each contact area is set to align with the position of each of the maximum possible number of pins. The contact areas 38 are formed on the front face 34 of the resilient switch card 30. Each contact area 38 is associated with an electrical circuit (not shown) on the electrical circuit board 32 such that when pressure is applied to the contact area, an electrical signal is generated in the corresponding electrical circuit (for example, by closing switch contacts, not shown, associated with the contact area). Each contact area 38 is preferably in the form of a pimple which is raised from the front face 34 of the resilient switch card 30.

In a rest position of a switch cap 20, the pin or pins 28 are positioned to exert no pressure on the contact areas 38 associated with the through bore 18 within which the switch cap is positioned. If the switch cap 20 is pushed (by a vehicle occupant) towards the resilient switch card 30, the pin or pins 28 on the switch cap exert a pressure on the or each associated contact area 38 on the resilient switch card. By monitoring the electrical signals on the electrical circuits on the electrical circuit board 32, the position and number of contact areas 38 subjected to pressure can be determined, and hence the associated switch cap 20 which has been pushed can be determined. Using this information, the electrical device associated with the pushed switch cap 20 can be operated as required.

Because the arrangement of the pins 28 on each switch cap 20 is unique to a particular electrical load, the relative positions of the switch caps in the housing 12 is irrelevant. As a consequence, the vehicle occupant may move the switch caps 20 from one through bore 18 to another, or may remove switch caps entirely, or may replace one switch cap by another (new) switch cap.

In order to provide a tactile response, biasing means may be provided to bias each switch cap 20 to its rest position. In the present embodiment, the biasing means is in the form of a number of enlarged pimples 40, one for each through bore 18, on the front face 34 of the resilient switch card 30 which engages the rear face 24 of the associated switch cap 20, or a separate pin 42 on the rear face. The biasing means also helps to ensure that a substantially constant pressure is applied to each relevant contact area 38 on pushing one of the switch caps 20, irrespective of the number and position of the pins 28 on the switch cap, and also provides an upper limited to the exerted pressure. To further prevent excess pushing of a switch cap 20, each switch cap may have a rearward facing shoulder 44 formed at the front face 22 of the switch cap which can engage the front face 14 of the housing 12 on pushing the switch cap. Illumination means (not shown) may be provided to illuminate each switch cap 20 and/or the symbol 26 on each switch cap.

What is claimed is:

1. A switch array (10) comprising a housing (12) having a front face (14), a rear face (16), and a plurality of through bores (18) extending from the front face to the rear face; a resilient switch card (30) having a front face (34) directed towards the rear face of the housing, a rear face (36) directed away from the housing, and a number of contact areas (38) on the front face associated with each one of the plurality of through bores (18) wherein the number and position of the contact areas associated with each one of the plurality of through bores (18) is identical; a switch cap (20) slidably mounted in, and removable from, one of the plurality of through bores (18), the switch cap having a front face (22) adjacent the front face of the housing, a rear face (24) adjacent the rear face of the housing, and one or more pins (28) projecting from the rear face of the switch cap, wherein the number and position of the one or more pins is predetermined, and wherein the one or more pins can exert pressure on a one of the number of contact areas associated with the at least one of the through bores on pushing the switch cap from a rest position; an electrical circuit board (32) mounted on the rear face of the resilient switch card and having an electrical circuit associated with each one of the number of contact areas such that when pressure is exerted on the one of the number of contact areas, an electrical signal is generated in the associated electrical circuit.

2. A switch array as claimed in claim 1, comprising a plurality of switch caps (20) including the switch cap of claim 1, wherein each of the plurality of switch caps can be slidably mounted in, and removable from, each one of the plurality of through bores (18) in the housing (12), and wherein the one or more pins projecting from the rear of each of the plurality of switch caps are unique in number and position.

3. A switch array as claimed in claim 1 or claim 2, wherein each of the number of contact areas (38) has a plurality of pimples which protrude from the front face (34) of the resilient switch card (30).

4. A switch array as claimed in claim 3 wherein biasing means (40) are provided to bias each of the plurality of switch caps (20) away from the resilient switch card (30).

5. A switch array (10) comprising a housing (12) having a front face (14), a rear face (16), and a plurality of through bores (18) extending from the front face to the rear face; a resilient switch card (30) having a front face (34) directed towards the rear face of the housing, a rear face (36) directed away from the housing, and a number of contact areas (38) on the front face associated with each one of the plurality of through bores (18) wherein the number and position of the contact areas associated with each one of the plurality of through bores (18) is identical; a plurality of switch caps (20) slidably mounted in, and removable from, respective ones of the plurality of through bores (18), the plurality of switch caps each having a front face (22) adjacent the front face of the housing, a rear face (24) adjacent the rear face of the housing, and one or more pins (28) projecting from the rear face of the housing that are unique in number and position, and wherein the one or more pins can exert pressure on one of the number of contact areas associated with one of the through bores on pushing one of the plurality of switch caps from a rest position; an electrical circuit board (32) mounted on the rear face of the resilient switch card and having an electrical circuit associated with each one of the number of contact areas such that when pressure is exerted on the one of the number of contact areas, an electrical signal is generated in the associated electrical circuit, and an enlarged pimple (40) for each one of the plurality of through bores (18) in the housing (12), formed on the front face (34) of the resilient switch card (30), and engageable with the rear face (24) of each of the plurality of switch caps when positioned in a corresponding through bore to bias each of the plurality of switch caps (20) away from the switch card (30).

6. A switch array as claimed in claim 5, wherein each of the plurality of switch caps (20) has, at the front face (22), a rearward facing shoulder (44) for engaging the front face (14) of the housing (12).

7. A switch array as claimed in claim 6, wherein the resilient switch card (30) is an elastomeric sheet.

8. A switch array as claimed in claim 7, wherein the electrical circuit board (32) is a printed circuit board or a flexible printed circuit.

9. A switch array as claimed in claim 8, wherein the front face (22) of each of the plurality of switch caps (20) has a symbol (26) marked thereon.

10. A switch array as claimed in claim 9, wherein illumination means are provided for each of the plurality of switch caps (20).

* * * * *